United States Patent [19]

Podobnik et al.

[11] 4,130,477

[45] Dec. 19, 1978

[54] FROTH FLOTATION PROCESS

[75] Inventors: Donald M. Podobnik, Cuajone, Peru; Guy H. Harris, Concord, Calif.

[73] Assignee: The Dow Chemical Company, Midland, Mich.

[21] Appl. No.: 862,998

[22] Filed: Dec. 21, 1977

Related U.S. Application Data

[63] Continuation-in-part of Ser. No. 754,764, Dec. 27, 1976, abandoned.

[51] Int. Cl.[2] ..... B03D 1/02

[52] U.S. Cl. ..... 209/166

[58] Field of Search ..... 209/166, 167; 260/609 R

[56] References Cited

U.S. PATENT DOCUMENTS

| | | | |
|---|---|---|---|
| 2,611,485 | 9/1950 | Treter | 209/166 |
| 2,674,619 | 4/1954 | Lundsted | 260/609 R |
| 3,053,903 | 9/1962 | Holland | 260/609 R |
| 3,440,287 | 4/1969 | Horsley | 260/609 R |
| 3,595,390 | 7/1971 | Booth | 209/166 |
| 3,661,851 | 5/1932 | Urbach | 260/609 R |
| 3,849,501 | 11/1974 | Mcloy | 260/609 R X |
| 3,865,718 | 2/1975 | Treter et al. | 209/166 |
| 3,894,093 | 7/1975 | Raizner | 260/609 R X |

FOREIGN PATENT DOCUMENTS

| | | | |
|---|---|---|---|
| 206326 | 10/1954 | Australia | 209/166 |
| 2237359 | 2/1973 | Fed. Rep. of Germany | 209/166 |

*Primary Examiner*—Robert Halper

[57] ABSTRACT

A process for the recovery of mineral values by froth flotation in an aqueous medium from mineral ores with the use of an effective amount of a mercaptan polyalkylene oxide frother.

22 Claims, No Drawings

FROTH FLOTATION PROCESS

CROSS-REFERENCE TO RELATED APPLICATION

The present application is a continuation-in-part of copending application Ser. No. 754,764, now abandoned filed Dec. 27, 1976.

BACKGROUND OF THE INVENTION

Froth flotation is a commonly employed process for concentrating minerals from ores. In a flotation process, the ore is crushed and wet ground to obtain a pulp. A frothing agent, usually employed with a collecting agent, is added to the ore to assist in separating valuable minerals from the undesired or gangue portions of the ore in subsequent flotation steps. The pulp is then aerated to produce a froth at the surface thereof and the collector assists the frothing agent in separating the mineral values from the ore by causing the mineral values to adhere to the bubbles formed during this aeration step. The adherence of the mineral values is selectively accomplished so that the portion of the ore not containing mineral values does not adhere to the bubbles. The mineral-bearing froth is collected and further processed to obtain the desired minerals. That portion of the ore which is not carried over with the froth, usually identified as "flotation tailings", is usually not further processed for extraction of mineral values therefrom. The froth flotation process is applicable to ores containing metallic and non-metallic mineral values.

In flotation processes, it is desirable to recover as much mineral values as possible from the ore while effecting the recovery in a selective manner, that is, without carrying over undesirable portions of the ore in the froth.

While a large number of compounds have foam or froth producing properties, frothers widely used in commercial froth flotation operations include polyalkylene glycol compositions and alkyl ethers thereof (see, for example, U.S. Pat. Nos. 3,595,390, 2,611,485 and 2,695,101). The frothers most widely used in froth flotation operations are compounds containing a nonpolar, water-repellant group and a single, polar, water-avid group such as hydroxyl (OH). Typical of this class of frothers are mixed amyl alcohols, methylisobutyl carbinol (MIBC), hexyl and heptyl alcohols, cresols, terpinol, etc. Other effective frothers used commercially are the $C_1$–$C_4$ alkyl ethers of polypropylene glycol, especially the methyl ether and the polypropylene glycols of 140–2100 molecular weight and particularly those in the 400–1100 range.

Although mineral recovery improvements from a preferred frother in the treatment of an ore can be as low as only about 1 percent over other frothers, this small improvement is of great importance economically since commercial operations often handle as much as 50,000 tons of ore daily. With the high throughput rates normally encountered in commercial flotation processes, relatively small improvements in the rate of mineral recovery result in the recovery of additional tons of minerals daily. Obviously, any frother which promotes improved mineral recovery, even though small, is very desirable and can be advantageous in commercial flotation operations, especially in view of increasing energy costs.

It is an object of the present invention to provide frothing agents which improve the selective recovery of mineral values from ores. Further, it is an object of the present invention to provide frothing agents which can be satisfactorily employed in present flotation processes. Further objects of the present invention will become evident in view of the details set forth hereinbelow.

In accordance with the present invention, it has been found that, in a process for collecting mineral values from an ore which comprises mixing ground ore with water to form an ore pulp, aerating said pulp in the presence of a frother agent, improved recovery results are obtained with mercaptan polyalkylene oxide compositions (hereinafter referred to as "mercaptan frothers") of the general formula:

$$R\,[S(EO)_x(PO)_y(BO)_z H]_n$$

wherein, in said formula,

EO = $C_2H_4O$, PO = $C_3H_6O$ and BO = $C_4H_8O$, n = 1 or 2, x = 0–4, y = 1–10, z = 0–2, and where n = 1, the average sum of the x, y and z groups is from 2 to about 12, R represents alkenyl of 3–5 carbon atoms, an alkyl group of from 1 to about 8 carbon atoms or an aryl group, and where n = 2 the average sum of all x+y+z groups is from 2 to about 12,

R represents a bridging $-(CH_2)_m-$ radical wherein m = 1–6, or a bridging benzylidene radical

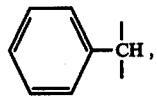

or mixtures of the above.

As used herein, the term "average sum" means the average number of EO, PO or BO groups per molecule in a given composition or mixture of compositions and also includes mixtures of compositions having varying amounts of the same alkylene oxide group such as, for example, a product mixture of frother compositions $RS(PO)_3H$, $RS(PO)_5H$ and $RS(PO)_7H$ wherein the average sum of PO groups per molecule in the product mixture is 5. The average sum of alkylene oxide groups present in a given mixture can readily be determined according to conventional procedures.

The pure compositions as such are useful in the method of the present invention although the reaction mixtures or mixed fractions are desirably utilized as these are effective and can be utilized without additional costly purification steps. The PO reactants ($C_3H_6O$) include 1,2- and 1,3-propylene oxide while the BO reactants ($C_4H_8O$) are meant to include only 1,2- and 2,3-butylene oxide.

As used herein, the term "alkyl" means and includes straight- or branched-chain radicals such as, for example, methyl, ethyl, isopropyl, butyl, t-butyl, pentyl, n-hexyl, isohexyl, heptyl, octyl, isooctyl and the like. The term "aryl" as used herein means, for example, phenyl, benzyl, and substituted phenyl radicals derived from, for example, toluene, ethyl, benzene, cumene, xylene, t-butyl benzene and the like. Likewise, the benzyl radicals can bear various substituents which do not affect the basic frother properties of the compositions. The term "alkenyl" includes the known propene, butene and pentene radicals.

Mixtures of compostions of the above formula are preferred for use in the present invention. Compositions of the above formula wherein n is 1 also constitute a preferred class herein. In another preferred class of frothers, n is 2. Compositions wherein n is 1 and R is alkyl or R is propenyl, constitute other preferred classes. In another preferred embodiment n is 1, z is 0 and the sum of x+y is from 2 to about 8. In another embodiment, mixtures of compositions wherein n is 1, z is 0 and the average sum of x+y is from about 2 to about 8 are preferred. Mixtures of the foregoing embodiment wherein R is also alkyl of 1 to about 6 carbon atoms comprise a further preferred class. Mixtures of compositions wherein n is 1, z is 0, the average sum of x+y is from 2 to about 8 and R is methyl are also preferred. In a further embodiment, mixtures of compositions wherein n is 1, x and z are each 0, the average sum of y is from 2 to about 8 and R is alkyl of 1 to about 6 carbon atoms are preferred. Mixtures of compositions wherein x and z are each 0 and the average sum of y is 5 or 7, respectively, constitute other preferred embodiments. Mixtures of compositions wherein n is 1, x and z are each 0, the average sum of y is 5 or 7, respectively, and R is alkyl of from 1 to about 6 carbon atoms are particularly preferred. In additional embodiments wherein n is 2 the following mixtures of compositions are also preferred: (a) z is 0, R is $-CH_{2-m}$ and m is from 1 to about 4; (b) z is 0, x is 0 and m is 1–4; (c) z is 0, the average sum of all x+y groups is 2 to about 8 and m is 2–4; (d) R is a benzylidene radical, and (e) z is zero, R is a benzylidene radical, and the average sum of all x+y groups per molecule is from 2 to about 8.

The frothers of the present invention are added to the ore and intimately mixed therewith either alone or together with a collector prior to and/or during the flotation step. The ore pulp-frother mixture is then treated under conditions to form a froth. The froth selectively removes the mineral values from the ore and the mineral-rich froth is separated from the ore flotation pulp and recovered. This value-depleted pulp which remains in the flotation cell is removed. The mineral-rich froth is then further treated to recover the desired mineral values. In accordance with the process of this invention it has been found that both the amount of mineral values which are recovered and the concentration of mineral values in the froth are substantially increased over prior processes which employ known frothers. These processing improvements are obtained with substantially the same or lower quantities of frothing agents as compared to those used currently in flotation operations. Accordingly, the present invention provides substantial advantages over prior processes.

The frothers of this invention can be employed in the flotation of metallic and non-metallic ores. Exemplary ores which are processed include sulfides and oxides of copper, molybdenum, lead, zinc, iron, nickel, cobalt, and the like. Such ores may also contain precious metal values. Other exemplary ores are phosphate rock, cement rock, glass sands, feldspars, fluorspars, micas, clays, talcs, coals and ores containing tungsten, manganese, sulfur, and water-soluble minerals such as sodium and potassium chlorides, and the like. The frothers of this invention are employed in amounts of from about 0.005 lbs. per ton ore to about 0.5 lb. per ton of ore; or preferably from about 0.01 lb. per ton ore to about 0.1 lb. per ton ore. Those skilled in the art will recognize that frother amounts will vary depending upon a given plant operation, ore type, etc., and that the optimum amount will be determined by mill trial runs. Preferably, the frothers are employed in the recovery of copper of molybdenum, preferably molybdenum.

The frothers of the present invention are prepared by methods known to the art, including block polymer preparation methods.

The frothers may be prepared by reacting an appropriate mercaptan of the formula RSH, where n is 1, or $R(SH)_2$ where n is 2, wherein R is as hereinabove defined, with an alkylene oxide (e.g., ethylene-, propylene- or butylene-oxide) or mixtures thereof. The greater the quantity of the alkylene oxide used, the longer the chain length and the higher the molecular weight of the mercaptan frother obtained. The mercaptan reactants utilized to prepare the mercaptan frother agents are known in the art and can be readily obtained or prepared by known methods by those skilled in the art. Typical of such mercaptan agents are, for example, methanethiol, 1,2-ethanedithiol, 1-butanethiol, 2-butanethiol, thiophenol, benzyl mercaptan, toluenethiol, 4-t-butylthiophenol, 1,6-dithiolhexane, 2-methyl-2-propanethiol, 1,2-propanedithiol, propenethiol and the like. Also, allyl alcohol can be reacted with a mercaptan RSH in the presence of UV light to give $RS(CH_2)_3OH$, which can then be further reacted with EO, PO or BO reactants to obtain the product desired.

The preparation of the frothers of the present invention is effected in the presence of a catalyst such as alkalies, e.g., sodium or potassium hydroxide. The reaction may be carried out sequentially with either the EO, PO or BO being added first or concurrently where two or more oxides are reacted as a mixture. Reaction temperatures up to about 150° C. to about 225° C. may be employed and pressures up to 1000 pounds or more per square inch may be used.

The mercaptan frothers useful in the present invention may be characterized in terms of their molecular weights. Products of molecular weight in the range of from about 150 to about 1000 are suitable for use as frothers with the range of about 200 to about 600 being preferred.

The quantities of reactants are adjusted so that a frother of desired molecular weight may be obtained. For example, a molar quantity of the mercaptan reactant is reacted with sufficient amounts of EO, PO or BO, either separately or in combination with one or both other oxides, so that the final polymeric condensate, in either block or random form, is of the molecular weight range desired. The amounts of EO, PO and BO necessary to achieve the various compositions within the above-defined formula will be readily apparent to those skilled in the art, who will also recognize that the chain length is based on an average determination of EO, PO and BO groups present.

The frothers of this invention can be employed either alone or in conjunction with standard frothers and with a conditioning agent or modifier and/or a water-soluble or oily collector or promoter. Suitable water-soluble collectors or promoters which can be employed in the flotation of sulfide or oxide metallic ores are alkali metal xanthates, sodium or potassium ethyl, isopropyl, secondary or isobutyl, amyl, or isoamyl and hexyl xanthates, alkyl thiols, and dithiophosphates such as dicresyl, diethyl, diisopropyl, disecondary or diisobutyl, diamyl or diisoamyl and dihexyl dithiophosphates as free acids or as sodium, potassium or ammonium salts, as well as mercaptobenzothiazole derivatives. Representative oily collectors which can be employed with the frothers of this invention include dithiocarbamates such as S-allyl-N-ethyldithiocarbamate, S-allyl-N-isopropyldithiocarbamate and S-allyl-N-methyl-dithiocarbamate, as well as allyl xanthates, dialkl thionocarbamates and (alkoxycarbonyl) alkylxanthates; these collectors are oil-soluble.

In the flotation of non-metallic ores, suitable water-soluble and oil-soluble collectors or promoters are oleic acid, crude and refined tall oil, and tall oil fatty acids, naphthenic acids, the sodium, potassium, and ammonium soaps of such acids, black liquor soap, petroleum sulfonates, organic phosphates and polyphosphates, sulfonated oils and fatty acids, sulfosuccinates and sulfosuccinamates. Cationic type collectors such as long chain amines or imidazolines are employed in the flotation of silica and silicates and water-soluble minerals.

Depending on the type of ore treated, conditioning or modifying agents such as alkalies and acids to adjust pH so as to improve selectivity, flotation depressants to inhibit the flotation of unwanted minerals, and activators to enhance flotability and improve flotation rates may be used with the frothers of this invention.

The following examples illustrate the process of the present invention and the superiority of the mercaptan frothers over related oxygen analogs, but are not intended to limit the same. In these examples, EO, PO and BO are used to designate ethylene oxide, propylene oxide and butylene oxide, respectively. If not otherwise indicated in the Examples or Tables, each EO, PO or BO group enclosed in parentheses is meant to designate the presence of one of said group.

EXAMPLE 1

Powdered sodium hydroxide (0.5 grams) and methyl mercaptan (48 grams) are placed in a one liter Parr bomb reactor equipped with a stirrer, an internal cooling coil and preheated to about 75° C. An EO-PO mixture (27.6 grams; prepared from 44 grams of EO and 232 grams of PO) is initially added, portionwise, to the reactor at a rate so as to maintain the temperature of the reactor below 150° C. The remainder of the EO-PO mixture is also subsequently added, portionwise, to the reactor and the resulting mixture is heated at 150° C. for a period of about one hour. The product $CH_3—S(EO)_x(PO)_yH$, x being 1 and y being an average of 4, is recovered in typical procedures.

EXAMPLE 2

Sodium hydroxide (0.9 grams) was dissolved with stirring in a solution of benzyl mercaptan (52.5 grams) in 150 methanol under a nitrogen pad. The mixture was cooled with an ice bath and propylene oxide (32.5 grams —⅓ excess molar amount) was slowly added thereto. Addition of the PO excess gave no exotherm. The resulting mixture was evaporated and the remaining oily residue was taken up in ether, washed with water and dried over magnesium sulfate. Removal of the ether and drying agent gave the desired benzyl mercaptan-PO product:

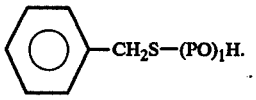

Analysis of NMR spectra confirmed the product.

EXAMPLE 3

In procedures similar to Example 2, 100 grams of ethanedithiol and 175 ml. of propylene oxide were reacted to give the desired mercaptan frother:

$$H(PO)—S—C_2H_4—S(PO)H$$

having an average of two PO groups per molecule.

EXAMPLE 4

In procedures similar to Example 2 above, 4-t-butylthiophenol (8.35 grams) was reacted with one equivalent of propylene oxide to give the desired product:

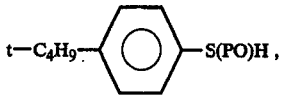

having one PO group per molecule which was confirmed by NMR spectra analysis.

EXAMPLE 5

The product from Example 2 (9.1 grams), powdered KOH (0.2 grams) were reacted with propylene oxide at 150° C. for a period of about 2 hours. The NMR spectra integration curve indicated obtention of a benzyl mercaptan-PO product:

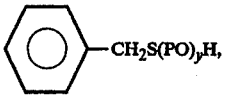

where y is an average sum of 2.7.

EXAMPLE 6

In procedures similar to those in Example 5 above, 15 grams of the product obtained in Example 3, powdered KOH (0.1 gram) and 10 ml. of propylene oxide were reacted to yield a product:

$$H(PO)_ySC_2H_4S(PO)_yH,$$

wherein the average sum of y+y was 4.

EXAMPLE 7

A portion (7.7 grams) of the product from Example 3 above was further reacted with PO (10.25 ml) to yield a product as in Example 6 wherein the average sum of y+y was 6.

EXAMPLE 8

A portion (4.2 ml) of the t-butyl mercaptan-PO product from Example 4 above was reacted with 1.5 molar equivalents of PO to give a product having an average PO content of 2.5.

EXAMPLE 9

6.7 grams of $CH_3S(EO)H$, previously prepared, was reacted with 0.1 gram of powdered KOH and 20.4 ml of PO at 150° C. for about 2 hours to give a mixed EO-PO product:

$$CH_3S(EO)_x(PO)_yH$$

wherein x is 1 and the average sum of y is 4. This product differs from that obtainable in Example 1 above wherein, on the average, only a portion of the EO moiety is attached directly to the sulfur atom. In the product obtained in this example, the EO groups in all molecules are attached directly to the sulfur atom.

EXAMPLE 10

As in Example 9, 9.1 grams of a previously prepared $C_4H_9S(EO)H$ product was reacted with powdered KOH (0.1 grams) and 19 ml. of propylene oxide to give a product $C_4H_9S(EO)_x(PO)_y$ H wherein x is 1 and having an average y of 4.

EXAMPLE 11

111.2 grams of a previously prepared product $CH_3S(PO)_yH$, wherein y is an average of 3 and about 5 grams of powdered KOH were reacted with 36 grams of BO. The BO was added portionwise and the exothermic reaction was maintained at a temperature of about 150°-160° C. Following the completion of the BO addition, the reaction mixture was heated at 150° C. for an additional one-half hour and then filtered hot through Celite. The resulting product was $CH_3S(PO)_y(BO)_zH$ wherein the average sum of y was 3 and z was 1.

EXAMPLE 12

In procedures similar to those of Example 11, a mixture of 16.8 grams of $CH_2(SC_2H_4OH)_2$, prepared according to *J. Amer. Chem. Soc.*, 63, 657 (1941), 34.8 grams of PO and 0.1 gram of powdered KOH is heated at 125° C. for 2 hours. The composition of the liquid product is $H(PO)_y(EO)SCH_2S(EO)(PO)_yH$ wherein the sum of y+y is an average of 6.

EXAMPLE 13

In procedures similar to Example 12, 24.4 grams of

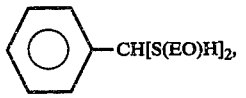

prepared according to Ber. 5813, 304 (1925), is reacted with 23.2 grams of PO and 0.1 gram of powdered KOH and the reaction mixture is heated for 2 hours at 125° C. As a result, the product

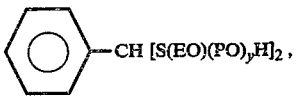

wherein y is an average total sum of 4, is obtained.

The foregoing examples illustrate typical procedures by which mercaptan frothers employed in the invention can be prepared. Other frothers within the scope of the invention can be similarly prepared by the foregoing or other analagous methods known by those skilled in the art.

The following procedure and examples further illustrate the method of the present invention.

In typical frother evaluation methods known to those skilled in the art, 500 gram samples of ore is crushed to −10 U.S. Mesh and then further ground in a rod mill with 300 milliliters of distilled water until substantially all of the sample passes through a 65 U.S. Mesh screen. An initial amount of a collector is added to the resulting ground slurry along with a kerosene-fuel oil mixture and lime, the final adjusted pH for flotation being about 10.2.

The slurry from the rod mill was washed into a Denver-type flotation cell. The cell is operated at about 1800 rpm, with an automatic paddle operating at about 10 rpm, with air being metered into the cell at a rate of about 7.0 scfm (standard cubic feet per minute). Frother is added to the slurry which is then conditioned for 2 minutes without air. The air is then turned on and a first flotation concentrate is subsequently obtained and removed as a result of 2 minutes flotation time. Additional collector is added to the slurry along with additional frother and the slurry is conditioned for 1 minute without air and then floated again with air for 2 minutes. This conditioning and floating procedure is repeated, (without removing the concentrate formed), giving a second combined (scavenger) concentrate which was floated for a total period of 4 minutes. The concentrate and remaining tail are then analyzed; where two concentrates from the same trial are obtained, the results are totaled. Results from separate trials with a test material are averaged.

EXAMPLE 14

Results, including the frother agent, total amount used per ton and percent recovery of copper (Cu) and molybdenum (Mo) obtained from trials with an Arizona ore according to the above procedures, are set forth below in Table I. A dialkylthionocarbamate (0.012 lbs./ton) was used as a primary collector while sodium isopropyl xanthate (0.005 lbs./ton) was used as a secondary collector. Mixed frother compositions were used.

TABLE I

| Run No. | Frother | lbs./ton | % Cu Recovery** | % Mo Recovery |
|---|---|---|---|---|
| (1) | MIBC* | 0.209 | 75.28 | 72.66 |
| (2) | $CH_3S(PO)_yH^{(a)}$ | 0.148 | 76.42 | 73.58 |
| (3) | $\phi CH_2S(PO)_yH^{(b)}$ | 0.220 | 76.45 | 74.51 |
| (4) | $H(PO)_ySC_2H_4S(PO)_yH^{(c)}$ | 0.220 | 77.86 | 73.55 |
| (5) | $CH_3S(PO)_y(BO)_zH^{(d)}$ | 0.198 | 78.38 | 78.68 |
| (6) | $CH_3S(EO)(PO)_yH^{(e)}$ | 0.198 | 77.81 | 77.16 |
| (7) | $C_4H_9S(EO)(PO)_yH^{(f)}$ | 0.168 | 76.72 | 72.92 |

*Commercial frother agent - methylisobutyl carbinol.
**Total of two concentrates.
(a) y = average of 5.
(b) $\phi$ = phenyl, y = average of 2.7.
(c) sum of y+y = average of 4.0.
(d) y = average of 3, z = 1.
(e) y = average of 4 - Example 9.
(f) y = average of 4.

The foregoing data illustrate the effectiveness of various mercaptan frothers used in the invention and the superiority of the same over a commercial standard, MIBC, even at substantially lower use rates. While increases of a single percent in recovery rates are significant, the mercaptan frothers tested above provide very significant and unexpected increases of from about 1% to as high as about 3-5%.

EXAMPLE 15

In operations utilizing the procedures of Example 14 above, certain frother mixtures of the invention were compared with related oxygen analogs. In all tests, isopropyl ethylthionocarbamate was used as a collector in the amount of 0.032 lbs./ton, the pH was about 10.75 and the ore was a Peruvian copper ore. The results are set forth below in Table II.

TABLE II

| Run No. | Frother | lbs/ton | % Cu Head | % Cu Tail | % Cu Recovery |
|---|---|---|---|---|---|
| (1) | DPM | 0.252 | 0.830 | 0.253 | 70.87 |
| (2) | DPMS | 0.238 | 0.831 | 0.178 | 79.74 |
| (3) | TPM | 0.136 | 0.787 | 0.240 | 70.65 |
| (4) | TPMS | 0.140 | 0.802 | 0.226 | 73.03 |

DPM = $CH_3O(PO)_2H$
DPMS = $CH_3S(PO)_2H$
TPM = $CH_3O(PO)_3H$
TPMS = $CH_3S(PO)_3H$

The mercaptan frothers having a total of 2 PO or 3PO units were clearly superior in frothing power over the corresponding oxygen analogs.

EXAMPLE 16

In other evaluations employing similar procedures, pH, collectors, etc., as in Example 14, the following results were obtained on a Peruvian copper ore:

TABLE III

| Run No. | Frother | lbs./ton | Recovery % Cu | Recovery % Mo |
|---|---|---|---|---|
| 1. | MIBC | 0.139 | 65.09 | 56.01 |
| 2. | $CH_3O(EO)(PO)_4H$ | 0.084 | 70.45 | 61.52 |
| 3. | $CH_3S(EO)(PO)_4H$ | 0.090 | 70.78 | 63.05 |

The above data indicate the superior frothing properties of the mercaptan frother, especially in Mo recovery, over a commercial standard, even at lower loading rates, and over a related oxygen analog.

EXAMPLE 17

In further trials employing the procedures of Example 14 and Peruvian copper ore samples the following results were obtained:

TABLE IV

| Run No. | *Frother | lbs/ton | Conc. Assay % Cu | Conc. Assay % Mo | Recovery % Cu | Recovery % Mo |
|---|---|---|---|---|---|---|
| (1) | [a]MIBC | 0.290 | 12.4 | 0.278 | 76.70 | 61.83 |
| (2) | [b]$CH_3O(PO)_yH$ | 0.234 | 14.3 | 0.334 | 76.48 | 68.22 |
| (3) | [c]$CH_3S(PO)_yH$ | 0.188 | 16.4 | 0.416 | 78.55 | 74.76 |
| (4) | [c]$CH_3S(PO)_yH$ | 0.226 | 15.9 | 0.384 | 77.19 | 77.28 |
| (5) | [c]$CH_3S(PO)_yH$ | 0.263 | 14.4 | 0.349 | 78.13 | 78.07 |

*isopropyl ethylthiono carbamate (0.03 lbs.ton) was used as a collector.
[a]methylisobutyl carbinol, % Cu recovery is average of two trials.
[b]y = average of 3.6, % Cu recovery is average of three runs, % Mo recovery is average of two trials.
[c]y = average of 3.75; % Cu recovery for Runs 3–5 is average of three trials, % Mo recovery is average of two trials for Runs 3–4 and three trials for Run 5.

The results of the above tests demonstrate the superior frothing properties of the mercaptan frothers as compared to commercial frothers (Runs 1–2), including an oxygen analog product (Run 2). In recovery of Cu, it is noted in Run 2 that use of the oxygen analog resulted in less Cu recovery than the standard (MIBC), whereas the frothers of the present invention resulted in from about 0.5 to about 2.0% increases in Cu recovery as compared with MIBC. Similarly, the frothers of Runs 3–5 exhibited for superior and unexpected frother properties in the recovery of Mo as compared with both MIBC and the oxygen analog of Run 2, Mo recovery being from 20–25 percent better than with MIBC, and from about 8 to about 15 percent better than with the oxygen analog.

In other operations, other mercaptan frothers as defined herein and mixtures thereof are found to possess similar frother properties.

We claim:

1. In a process for collecting mineral values from an ore which comprises mixing ground ore with water to form an ore pulp and aerating said pulp in the presence of an effective amount of a frother, the improvement which comprises carrying out said process with a frother of the formula:

$$R[S(EO)_x(PO)_y(BO)_zH]_n$$

wherein, in said formula,
EO = $C_2H_4O$, PO = $C_3H_6O$ and BO = $C_4H_8O$,
n = 1 or 2,
x = 0–4,
y = 1–10,
z = 0–2,
and where n = 1,
the average sum of the x, y and z groups is from 2 to about 12,
R represents alkenyl of 3–5 carbon atoms, an alkyl group of from 1 to about 8 carbon atoms or an aryl group, and
where n = 2
the average sum of all x+y+z groups is from 2 to about 12,
R represents, a bridging —$(CH_2)_m$—radical wherein m = 1–6, or a bridging benzylidene radical

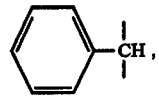

or frother mixtures of the above formula.

2. The process of claim 1 wherein the frother is employed with a mineral collector.

3. The process of claim 1 wherein n is 1.

4. The process of claim 3 wherein frother mixtures are employed.

5. The process of claim 3 wherein R is alkyl.

6. The process of claim 3 wherein R is propenyl.

7. The process of claim 4 wherein z is 0 and the average sum of x+y is from about 2 to about 8.

8. The process of claim 7 wherein R is alkyl of from 1 to about 6 carbon atoms.

9. The process of claim 8 wherein R is methyl.

10. The process of claim 4 wherein x and z are 0, the average sum of y is from about 2 to about 8 and R is alkyl of from 1 to about 6 carbon atoms.

11. The process of claim 4 wherein x and z are each 0 and y is an average sum of 5.

12. The process of claim 11 wherein R is alkyl of from 1 to about 6 carbon atoms.

13. The process of claim 12 wherein R is methyl.

14. The process of claim 4 wherein x and z are each 0 and y is an average sum of 7.

15. The process of claim 14 wherein R is alkyl of from 1 to about 6 carbon atoms.

16. The process of claim 15 wherein R is methyl.

17. The process of claim 1 wherein n is 2.

18. The process of claim 17 wherein frother mixtures are employed.

19. The process of claim 18 wherein z is zero, R is $-(CH_2)_m-$ and m is from 1 to about 4.

20. The process of claim 18 wherein z is 0, the average sum of x+y is from about 2 to about 8 and m is 2–4.

21. The process of claim 18 wherein R is a benzylidene radical.

22. The process of claim 21 wherein x is 0 and the average sum of x+y is from about 2 to about 8.

* * * * *

UNITED STATES PATENT AND TRADEMARK OFFICE

CERTIFICATE OF CORRECTION

PATENT NO. : 4,130,477

DATED : December 19, 1978

INVENTOR(S) : Donald M. Podobnik and Guy H. Harris

It is certified that error appears in the above-identified patent and that said Letters Patent are hereby corrected as shown below:

Column 12, line 5, Claim 22, "x" should be -- z -- .

Signed and Sealed this

*Tenth* Day of *April 1979*

[SEAL]

*Attest:*

RUTH C. MASON
*Attesting Officer*

DONALD W. BANNER
*Commissioner of Patents and Trademarks*